US011634986B2

(12) United States Patent
Hu et al.

(10) Patent No.: US 11,634,986 B2
(45) Date of Patent: Apr. 25, 2023

(54) SUPERCRITICAL FLUID DRILLING AND BLASTING INTEGRATED DOUBLE-ARM DRILL JUMBO AND CONTROL METHOD THEREOF

(71) Applicant: HOHAI UNIVERSITY, Jiangsu (CN)

(72) Inventors: Shaobin Hu, Jiangsu (CN); Yukang Cai, Jiangsu (CN); lingzhi Xi, Zhejiang (CN); huai Yang, Zhejiang (CN); Zhengyong Yan, Jiangsu (CN); Shuogang Pang, Jiangsu (CN); qiang Zhang, Zhejiang (CN); Lin Zhang, Jiangsu (CN); chen Li, Zhejiang (CN)

(73) Assignees: HOHAI UNIVERSITY, Jiangsu (CN); POWERCHINA Huandong Engineering Corporation Limited, Zhejiang (CN)

( * ) Notice: Subject to any disclaimer, the term of this patent is extended or adjusted under 35 U.S.C. 154(b) by 0 days.

(21) Appl. No.: 17/745,882

(22) Filed: May 17, 2022

(65) Prior Publication Data

US 2022/0364468 A1 Nov. 17, 2022

(30) Foreign Application Priority Data

May 17, 2021 (CN) ..... 202110535412.5

(51) Int. Cl.

| | |
|---|---|
| ***E21C 37/14*** | (2006.01) |
| ***E21B 7/02*** | (2006.01) |
| *E21D 9/00* | (2006.01) |

(52) U.S. Cl.

CPC ..... *E21C 37/14* (2013.01); *E21B 7/025* (2013.01); *E21B 7/027* (2013.01); *E21D 9/006* (2013.01)

(58) Field of Classification Search

CPC ..... E21B 43/2605; E21B 7/022; E21B 7/025; E21B 7/027; E21B 43/26; E21B 43/2607;

(Continued)

(56) References Cited

U.S. PATENT DOCUMENTS 4,508,035 A * 4/1985 Mashimo ..... E21B 7/025 299/13
5,803,551 A * 9/1998 McCarthy ..... E21C 37/12 299/13

FOREIGN PATENT DOCUMENTS

CN 101765694 A * 6/2010 ..... E21B 44/02
CN 106195616 A * 12/2016 ..... E21C 37/14

(Continued)

*Primary Examiner* — Abby J Flynn
*Assistant Examiner* — Michael A Goodwin
(74) *Attorney, Agent, or Firm* — JCIPRNET

(57) ABSTRACT

A control method of a drill jumbo is provided. The drill jumbo includes a pre-splitting arm, a drill arm, and a chamber. The pre-splitting arm includes a positioning device, a fixing buckle, a longer rod, an electric telescopic rod, and a water injection opening. The chamber includes a constant pressure valve, an excitation circuit, and a port. A computer controls the positioning device to perform positioning, afterwards, the fixing buckle is opened, the telescopic rod is started, the longer rod is jacked into a position in the hole, and oil is injected into a hydraulic expansion capsule. After blocking of the hole is completed, water is injected into the water injection opening. The port is opened to inject a mixed-phase fluid. The port is closed, the excitation circuit is started, and after a pressure rises to a set value, the constant pressure valve is opened.

6 Claims, 3 Drawing Sheets

(58) Field of Classification Search
CPC ..... E21B 43/263; E21C 37/14; E21C 37/06; E21C 37/08; E21C 37/10; E21C 37/12; E21D 9/006
See application file for complete search history.

(56) References Cited

FOREIGN PATENT DOCUMENTS

| | | | | | |
|---|---|---|---|---|---|
| CN | 107676092 A | * | 2/2018 | ..... | E21C 37/14 |
| CN | 109798120 | | 5/2019 | | |
| CN | 110685596 A | * | 1/2020 | ..... | E21B 15/00 |
| CN | 111502659 | | 8/2020 | | |
| CN | 111608631 A | * | 9/2020 | ..... | E21B 15/00 |

* cited by examiner

SUPERCRITICAL FLUID DRILLING AND BLASTING INTEGRATED DOUBLE-ARM DRILL JUMBO AND CONTROL METHOD THEREOF

CROSS-REFERENCE TO RELATED APPLICATION

This application claims the priority benefit of China application serial no. 202110535412.5, filed on May 17, 2021. The entirety of the above-mentioned patent application is hereby incorporated by reference herein and made a part of this specification.

BACKGROUND

Technical Field

The present invention relates to a supercritical fluid drilling and blasting integrated double-arm drill jumbo and a control method thereof, and belongs to the field of tunnel and underground space drilling and cracking construction.

Description of Related Art

The drilling and cracking method is an enduring method in tunnel and underground space excavation. With the increasing labor costs and the increasing requirements for personnel health and the environment of the construction site, the trend of mechanization is becoming more and more obvious. At present, China has achieved mechanization in the basic operations of drilling and cracking. However, the drilling operation is generally carried out by a manually controlled drill jumbo or multi-boom jumbo, and the explosive loading, filling, and blasting operations are also carried out manually. On the one hand, the manual control of the jumbo leads to low efficiency, low drilling precision, over-excavation/under-excavation, and poor quality. On the other hand, the manual loading and filling under the unstable surrounding rock caused by blasting is very dangerous, and the explosive blasting site suffers from severe noise and air pollution. In addition, the two operation lines, i.e., drilling and blasting, are not integrated into one mechanical equipment, resulting in a low degree of mechanization, low construction efficiency, and poor construction quality.

In order to reduce the vibration of the surrounding rock mass, improve the safety of operation and protect the environment of the construction site, novel rock breaking technologies that fracture rock mass by expansion of high-energy gas have been developed. Among others, especially the $CO_2$ phase-change fracturing technology has received extensive attention in the fields of mining, tunneling, and municipal transportation in recent years. However, there is no example of combining such technologies with a drill jumbo for excavation.

SUMMARY

To solve the defects of the prior art, the present invention provides a supercritical fluid drilling and blasting integrated double-arm drill jumbo and a control method thereof, to solve the problems of low degree of mechanization, low construction efficiency, poor construction quality, severe environmental pollution, and poor safety of the conventional combination methods.

To solve the above technical problems, the following technical solutions are employed in the present invention.

A supercritical fluid drilling and blasting integrated double-arm drill jumbo is provided, including a pre-splitting arm, a drill arm, a storage tank, a motor, an oil pump, an oil tank, a bearing platform, and an operation chamber. The pre-splitting arm and the drill arm are configured for fracturing and drilling respectively, and the pre-splitting arm and the drill arm are respectively connected to two sides of a front end of the operation chamber. The storage tank, the motor, the oil pump, and the oil tank are sequentially arranged at a rear end of the operation chamber, and are all arranged above the bearing platform. A liquid gas is stored in the storage tank, the motor is configured to provide power for positioning and drilling of the drill arm and the pre-splitting arm, and the oil tank is configured to store and supply oil for the oil pump.

The pre-splitting arm includes a positioning device, an arc sliding base, a fixing plate, a fixing buckle, a longer rod, a connecting block, an electric telescopic rod, a water injection opening, and a pressure transmission opening. The arc sliding base is arranged on the fixing plate, the positioning device is arranged at an end of the fixing plate.

The longer rod, the electric telescopic rod, and the connecting block are all arranged on the arc sliding base, and the fixing buckle is fixed on the arc sliding base and is configured to fix the longer rod.

The longer rod includes a hydraulic expansion capsule and an oil injection opening provided at a bottom of the hydraulic expansion capsule. The longer rod is connected to the connecting block through threads, the connecting block is connected to the electric telescopic rod, and a baffle plate is arranged at an end of the electric telescopic rod. The water injection opening and the pressure transmission opening are provided on the connecting block. The water injection opening, the pressure transmission opening, and the oil injection opening are each connected to a pressure-resistant hose through a bolt.

A supercritical fluid generation chamber is further arranged at the rear end of the operation chamber, the supercritical fluid generation chamber includes a constant pressure valve, an excitation circuit, and a mixed-phase fluid injection port, and the constant pressure valve and the pressure transmission opening are connected by a pressure-resistant hose. A mixed-phase fluid injected through the mixed-phase fluid injection port includes a liquid gas mixed with a cracking agent.

The oil pump is connected to the hydraulic expansion capsule on the pre-splitting arm and is configured to inject or pump out oil. The storage tank is connected to the mixed-phase fluid injection port by a pressure-resistant hose.

Further, a personnel seat, an operating platform, and a computer are arranged in the operation chamber.

Further, the operation chamber and the supercritical fluid generation chamber are arranged above the bearing platform.

Further, the double-arm drill jumbo further includes supporting legs and a crawler chassis, the crawler chassis is configured for driving and rotation of the drill jumbo as a whole, the bearing platform is arranged on the crawler chassis, and the supporting legs are configured to maintain stability of the drill jumbo during construction.

Further, the storage tank stores liquid water, liquid carbon dioxide, or liquid nitrogen.

Further, the valve is arranged on the mixed-phase fluid injection port.

A control method of the supercritical fluid drilling and blasting integrated double-arm drill jumbo is also provided. During operation, a computer controls the positioning device to perform positioning according to information collected after drilling of a hole by the drill arm. After the positioning is completed, the fixing buckle on the arc sliding base is controlled to be opened, the electric telescopic rod is started, the longer rod is jacked into a proper position in the hole, and the oil is injected into the hydraulic expansion capsule through the oil pump. After blocking of an opening of the hole is completed, water is injected into the water injection opening until a gap space is filled. The mixed-phase fluid injection port is opened to inject the mixed-phase fluid, the mixed-phase fluid injection port is closed, the excitation circuit is started, and after a pressure rises to a set value, the constant pressure valve is automatically opened, and rock mass is fractured. The control method includes the following steps.

S1: Pre-drilling/cracking preparation. Loading a drilling plan into a computer in the operation chamber, connecting the computer to a scanner, arranging the electric telescopic rod, the connecting block, and the longer rod in sequence on the arc sliding base, and controlling the fixing buckle to buckle. Carrying out a first pre-drilling and pre-splitting, collecting a petrophysical parameter and influence of the pre-splitting on a surrounding area, and feeding the petrophysical parameter and the influence of the pre-splitting back to a system to optimize a drilling and cracking plan and a construction process.

S2: Automatic positioning and drilling. Automatically making, by the system, a judgment according to the petrophysical parameter and the influence of the pre-splitting, to control the drill arm to carry out positioning and drilling, and the drill arm exiting after drilling a hole, and drilling a next hole.

S3: Hole sealing. Obtaining, by the computer, information obtained after a hole is drilled by the drill arm. Controlling the pre-splitting arm to extend into the corresponding hole. Synchronously collecting spatial position information by a three-dimensional scanner after the pre-splitting arm reaches a specific position. Feeding back the spatial position information. After confirmation, controlling the oil pump to inject the oil into the hydraulic expansion capsule to achieve hole sealing. Performing a next step after detecting that a hole sealing pressure reaches a set value.

S4: Water injection and filling. After the hole sealing is completed, injecting water through the water injection opening to fill an empty space until the set pressure is reached.

S5: Mixed-phase fluid injection. Setting, by the system, weights of and a ratio between the cracking agent and the fluid according to the petrophysical parameter, opening the valve, injecting a set volume of the fluid quantitatively mixed with the cracking agent through the mixed-phase fluid injection port, and closing the valve.

S6: Starting of the excitation circuit. Starting, by the computer, the excitation circuit to form a state of high temperature and high pressure. After a pressure reaches a pressure set for the constant pressure valve, the pressure rushing out, with an impact force being transmitted to rock mass by water medium to pre-crack the rock mass.

S7: After one operation cycle is completed, repeating the steps S2-S3 by the drill arm, and repeating the steps S3-S6 by the pre-splitting arm.

Further, main parameters in each step are fed back to a control terminal for a remote technician to make judgments and adjustments.

Compared with the prior art, the present invention has the following beneficial effects.

The present invention realizes the continuous operation of the fracturing pipe and the high integration of multiple functions including automatic positioning, automatic hole sealing, and automatic blasting, and replaces the manual transportation of explosives and the manual hole sealing with soil and sand in the conventional blasting, thereby greatly improving the construction efficiency and construction safety, ensuring the construction quality, and achieving a higher level of mechanization. Compared with the method of single blasting using high-energy gas, such a continuous blasting method with the integration of the pipe and the vehicle greatly improves the construction efficiency and construction quality.

1. The fracturing tube is directly mounted on the drill arm to carry out the drilling and cracking operation, which replaces the conventional manual injection of supercritical fluid, vehicle-based lifting into the hole, and manual hole sealing, is safe and efficient and reduces the possibility of accidents.

2. The hydraulic expansion capsule expands with the injection of oil to block the hole, so as to block the supercritical fluid in the hole, thereby preventing the supercritical fluid from leaking to reduce the phase transition pressure and affect the rock breaking effect, and preventing the supercritical fluid from rushing out to cause safety accidents.

3. The supercritical fluid generation chamber is configured to generate a supercritical fluid to impact and break rock, and includes an automatic feeding unit, a circuit excitation unit, and a pressure relief control unit. In this way, the safety risks of manual injection and transportation are eliminated. Because the supercritical fluid is automatically injected after the pre-splitting arm enters the drilled hole and carries out hydraulic hole sealing, the safety is greatly improved.

4. The positioning system, the feeding system, pressure relief control, and the correction of the drilling and cracking plan can all be controlled by a computer, and can also be controlled manually to avoid accidents, thereby providing double protection.

DESCRIPTION OF THE EMBODIMENTS

The specific embodiments of the present invention will be further described in detail with reference to FIG. 1 to FIG. 4.

Embodiment 1

Figure 1:
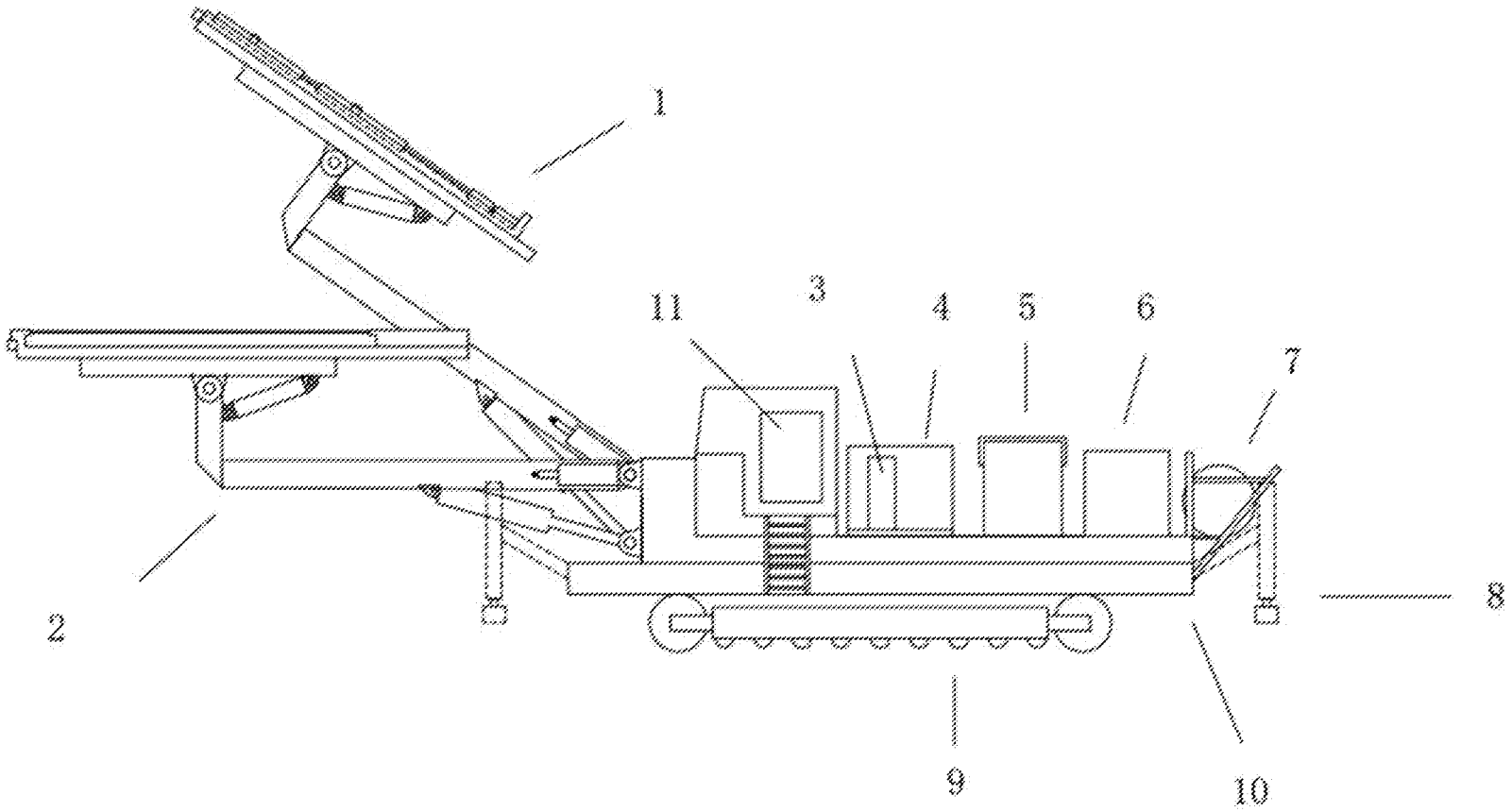
FIG. 1 is a schematic diagram of a supercritical fluid (hydrothermal) drilling and blasting integrated double-arm drill jumbo according to the present invention.

As shown in FIG. 1, a supercritical fluid (hydrothermal) drilling and blasting integrated double-arm drill jumbo according to the present invention includes a pre-splitting arm 1, a drill arm 2, a storage tank 4, a motor 5, an oil pump 6, an oil tank 7, supporting legs 8, a crawler chassis 9, a bearing platform 10, and an operation chamber 11. The pre-splitting arm 1 and the drill arm 2 are configured for fracturing and drilling respectively, and the pre-splitting arm 1 and the drill arm 2 are respectively connected to two sides of a front end of the operation chamber 11. A personnel seat, an operating platform, and a computer are arranged in the operation chamber 11. The storage tank 4, the motor 5, the oil pump 6, and the oil tank 7 are sequentially arranged at a rear end of the operation chamber 11, and are all arranged above the bearing platform 10. A liquid gas is stored in the storage tank 4, the motor 5 is configured to provide power for positioning and drilling of the drill arm 2 and the pre-splitting arm 1, and the oil tank 7 is configured to store and supply oil for the oil pump 6. The crawler chassis 9 is configured for driving and rotation of the drill jumbo as a whole, the bearing platform 10 is arranged on the crawler chassis 9, and the supporting legs 8 are configured to maintain stability of the drill jumbo during construction.

Figure 2:
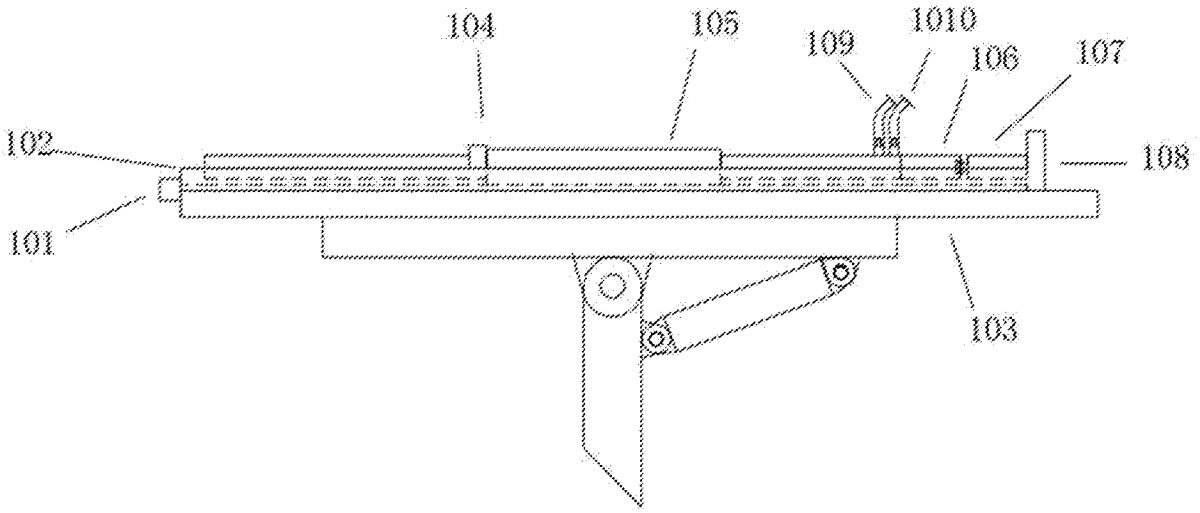
FIG. 2 is a schematic structural diagram of a pre-splitting arm according to the present invention.
Figure 3:
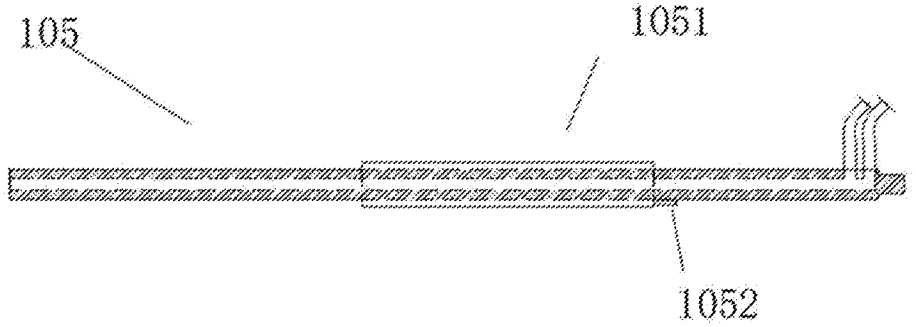
FIG. 3 is a schematic cross-sectional view of a longer rod in a pre-splitting arm configuration according to the present invention.

As shown in FIG. 2 to FIG. 3, the pre-splitting arm 1 includes a positioning device 101, an arc sliding base 102, a fixing plate 103, a fixing buckle 104, a longer rod 105, a connecting block 106, an electric telescopic rod 107, a water injection opening 109, and a pressure transmission opening 1010. The arc sliding base 102 is arranged on the fixing plate 103. The positioning device 101 is arranged at an end of the fixing plate 103. The longer rod 105, the electric telescopic rod 107, and the connecting block 106 are all arranged on the arc sliding base 102, and the fixing buckle 104 is also fixed on the arc sliding base 102 and is configured to fix the longer rod 105. The longer rod 105 includes a hydraulic expansion capsule 1051 and an oil injection opening 1052 provided at a bottom of the hydraulic expansion capsule 1051. The longer rod 105 is connected to the connecting block 106 through threads, the connecting block 106 is connected to the electric telescopic rod 107, and a baffle plate 108 is arranged at an end of the electric telescopic rod 107. The water injection opening 109 and the pressure transmission opening 1010 are provided on the connecting block 106. The water injection opening 109, the pressure transmission opening 1010, and the oil injection opening 1052 are each connected to a pressure-resistant hose through a bolt.

Figure 4:
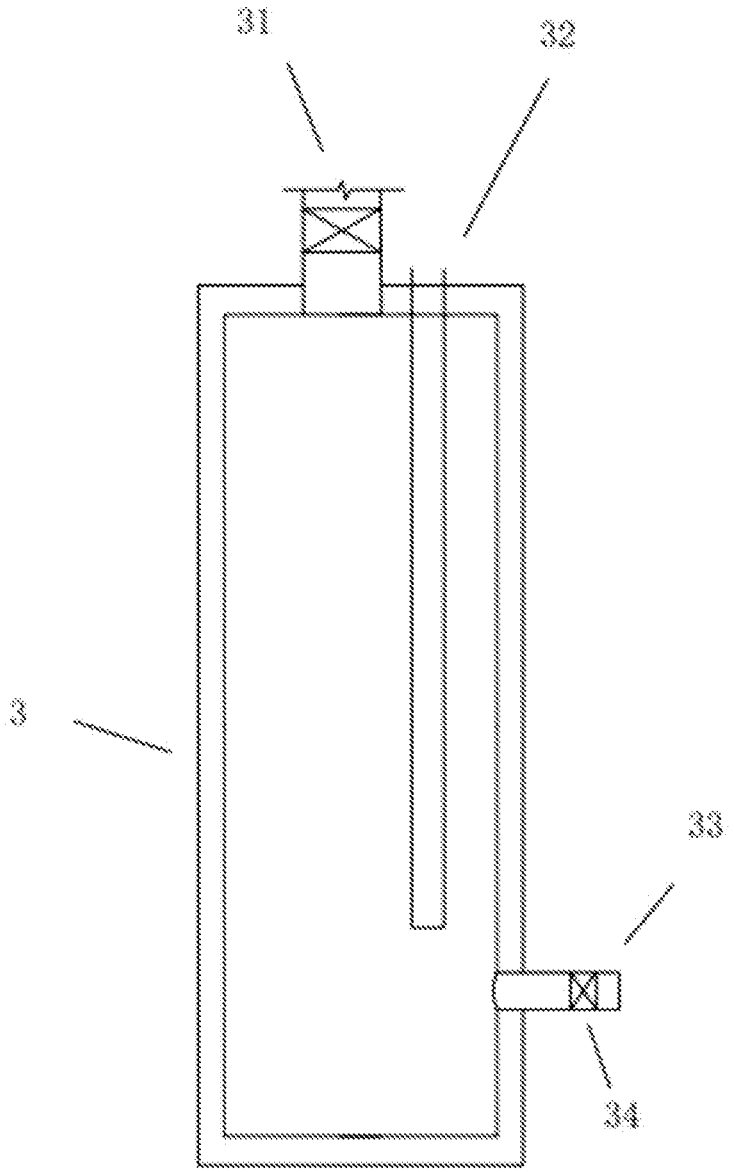
FIG. 4 is a schematic structural diagram of a supercritical fluid generation chamber according to the present invention.

As shown in FIG. 1 and FIG. 4, a supercritical fluid generation chamber 3 is further arranged at the rear end of the operation chamber 11, and the operation chamber 11 and the supercritical fluid generation chamber 3 are arranged above the bearing platform 10. The supercritical fluid generation chamber 3 includes a constant pressure valve 31, an excitation circuit 32, and a mixed-phase fluid injection port 33, and the constant pressure valve 31 and the pressure transmission opening 1010 are connected by a pressure-resistant hose. A mixed-phase fluid injected through the mixed-phase fluid injection port 33 includes liquid carbon dioxide mixed with a cracking agent. The valve 34 is arranged on the mixed-phase fluid injection port 33. The oil pump 6 is connected to the hydraulic expansion capsule 1051 on the pre-splitting arm 1 and is configured to inject or pump out oil. The storage tank 4 is connected to the mixed-phase fluid injection port 33 by a pressure-resistant hose. In this embodiment, the storage tank 4 stores liquid carbon dioxide.

A control method of the supercritical fluid drilling and blasting integrated double-arm drill jumbo is provided. During operation, a computer controls the positioning device 101 to perform positioning according to information collected after drilling of a hole by the drill arm 2. After the positioning is completed, the fixing buckle 104 on the arc sliding base 102 is controlled to be opened, the electric telescopic rod 107 is started, the longer rod 105 is jacked into a proper position in the hole, and the oil is injected into the hydraulic expansion capsule 1051 through the oil pump 6. After blocking of an opening of the hole is completed, water is injected into the water injection opening 109 until a gap space is filled. The mixed-phase fluid injection port 33 is opened to inject the mixed-phase fluid. The mixed-phase fluid injection port 33 is closed, the excitation circuit 32 is started, and after a pressure rises to a set value, the constant pressure valve 31 is automatically opened, and rock mass is fractured. The control method includes the following steps:

S1: Pre-drilling/cracking preparation: A drilling plan is loaded into a computer in the operation chamber 11. The computer is connected to a scanner. The electric telescopic rod 107, the connecting block 106, and the longer rod 105 are arranged in sequence on the arc sliding base 102. The fixing buckle 104 is controlled to buckle. A first pre-drilling and pre-splitting are carried out. A petrophysical parameter and influence of the pre-splitting on a surrounding area are collected, and fed to a system to optimize a drilling and cracking plan and a construction process.

S2: Automatic positioning and drilling: The system automatically makes a judgment according to the petrophysical parameter and the influence of the pre-splitting, to control the drill arm 2 to carry out positioning and drilling. The drill arm 2 exits after drilling a hole, and drills a next hole.

S3: Hole sealing: The computer obtains information obtained after a hole is drilled by the drill arm 2. The pre-splitting arm 1 is controlled to extend into the corresponding hole. After the pre-splitting arm 1 reaches a specific position, spatial position information is synchronously collected by a three-dimensional scanner and fed back. After confirmation, the oil pump 6 is controlled to inject the oil into the hydraulic expansion capsule 1051 to achieve hole sealing. A next step is performed after detecting that a hole sealing pressure reaches a set value.

S4: Water injection and filling: After the hole sealing is completed, water is injected through the water injection opening 109 to fill an empty space until the set pressure is reached.

S5: Mixed-phase fluid injection: The system sets weights of and a ratio between the cracking agent and the fluid according to the petrophysical parameter. The valve 34 is opened. A set volume of the fluid quantitatively mixed with the cracking agent is injected through the mixed-phase fluid injection port 33. Then, the valve 34 is closed.

S6: Starting of the excitation circuit: The computer starts the excitation circuit 32 to form a state of high temperature and high pressure. After a pressure reaches a pressure set for the constant pressure valve 31, the pressure rushes out, with an impact force being transmitted to rock mass by water medium to pre-crack the rock mass.

S7: After one operation cycle is completed, the steps S2-S3 are repeated by the drill arm 2, and the steps S3-S6 are repeated by the pre-splitting arm 1.

Embodiment 2

In this embodiment, the mixed-phase fluid used is liquid nitrogen, and the storage tank 4 stores liquid nitrogen. Other structures, connection methods, and control methods are the same as those in Embodiment 1, so the details will not be described herein again.

Further, main parameters in each step are fed back to a control terminal for a remote technician to make judgments and adjustments. The above embodiments are merely provided for illustrating the technical solutions of the present invention more clearly, and are not intended to limit the present invention. Modifications made by those of ordinary skill in the art to the technical solutions of the present application according to common knowledge in the field also fall within the scope of protection of the present application. Therefore, the above embodiments are examples only, and the scope of protection of the present application is subject to the scope of the appended claims.

What is claimed is:

1. A control method of a supercritical fluid drilling and blasting integrated double-arm drill jumbo, wherein the supercritical fluid drilling and blasting integrated double-arm drill jumbo comprises a pre-splitting arm, a drill arm, a storage tank, a motor, an oil pump, an oil tank, a bearing platform, and an operation chamber; wherein the pre-splitting arm and the drill arm are configured for fracturing and drilling, respectively, and the pre-splitting arm and the drill arm are respectively connected to two sides of a front end of the operation chamber; the storage tank, the motor, the oil pump, and the oil tank are sequentially arranged at a rear end of the operation chamber, and are all arranged above the bearing platform; a liquid gas is stored in the storage tank, the motor is configured to provide power for positioning and drilling of the drill arm and the pre-splitting arm, and the oil tank is configured to store and supply oil for the oil pump;

the pre-splitting arm comprises a positioning device, an arc sliding base, a fixing plate, a fixing buckle, a first rod, a connecting block, an electric telescopic rod, a water injection opening, and a pressure transmission opening; the arc sliding base is arranged on the fixing plate, the positioning device is arranged at an end of the fixing plate, the first rod, the electric telescopic rod, and the connecting block are all arranged on the arc sliding base, and the fixing buckle is fixed on the arc sliding base and is configured to fix the first rod;

the first rod comprises a hydraulic expansion capsule and an oil injection opening provided at a bottom of the hydraulic expansion capsule; the longer first rod is connected to the connecting block through threads, the connecting block is connected to the electric telescopic rod, and a baffle plate is arranged at an end of the electric telescopic rod; the water injection opening and the pressure transmission opening are provided on the connecting block; the water injection opening, the pressure transmission opening, and the oil injection opening are respectively connected to different pressure-resistant hoses;

a supercritical fluid generation chamber is further arranged at the rear end of the operation chamber, the supercritical fluid generation chamber comprises a constant pressure valve, an excitation circuit, and a mixed-phase fluid injection port, and the constant pressure valve and the pressure transmission opening are connected by a pressure-resistant hose; a mixed-phase fluid injected through the mixed-phase fluid injection port comprises a cracking agent mixed with one selected from the group consisting of liquid water, liquid carbon dioxide, and liquid nitrogen;

the oil pump is connected to the hydraulic expansion capsule on the pre-splitting arm and is configured to inject or pump out oil; the storage tank is connected to the mixed-phase fluid injection port by a pressure-resistant hose;

a working principle of the supercritical fluid drilling and blasting integrated double-arm drill jumbo is that:

during operation, a computer controls the positioning device to position the pre-splitting arm according to information collected after drilling of a hole by the drill arm; after the positioning is completed, the fixing buckle on the arc sliding base is controlled to be opened, the electric telescopic rod is started, the first rod is jacked into a position in the hole, and the oil is injected into the hydraulic expansion capsule through the oil pump to block an opening of the hole, and then water is injected into the water injection opening until a gap space is filled; the mixed-phase fluid injection port is opened to inject the mixed-phase fluid; the mixed-phase fluid injection port is closed, the excitation circuit is started, and after a pressure rises to a set value, the constant pressure valve is automatically opened, and a rock mass is fractured;

the control method comprising the following steps:

S1: pre-drilling/cracking preparation: loading a drilling plan into the computer, connecting the computer to a scanner, arranging the electric telescopic rod, the connecting block, and the first rod in sequence on the arc sliding base, and controlling the fixing buckle to buckle; carrying out a first pre-drilling and pre-splitting, collecting a petrophysical parameter and influence of the pre-splitting on an area surrounding the hole, and feeding the petrophysical parameter and the influence of the pre-splitting back to a system to optimize the drilling plan;

S2: automatic positioning and drilling: automatically making, by the system, a judgment according to the petrophysical parameter and the influence of the pre-splitting, to control the drill arm to carry out positioning and drilling, and the drill arm exiting after drilling a hole, and drilling a next hole;

S3: hole sealing: obtaining, by the computer, information obtained after a hole is drilled by the drill arm; controlling the pre-splitting arm to extend into the hole drilled by the drill arm; collecting spatial position information by the scanner after the pre-splitting arm reaches a specific position; feeding back the spatial position information to the computer; controlling the oil pump to inject the oil into the hydraulic expansion capsule to achieve hole sealing; confirming that a hole sealing pressure reaches a set value;

S4: water injection and filling: after the hole sealing is completed, injecting water through the water injection opening to fill the gap space until a set pressure is reached;

S5: mixed-phase fluid injection: setting, by the system, weights of and a ratio between the cracking agent and the fluid according to the petrophysical parameter, opening an injection valve, injecting a set volume of the fluid mixed with the cracking agent through the mixed-phase fluid injection port, and closing the injection valve;

S6: starting of the excitation circuit: starting, by the computer, the excitation circuit to form a state of high temperature and high pressure; after a pressure reaches a pressure set for the constant pressure valve, the pressure rushing out, with an impact force being transmitted to the rock mass by water medium to pre-crack the rock mass; and S7: after one operation cycle is completed, repeating the steps S2-S3 by the drill arm, and repeating the steps S3-S6 by the pre-splitting arm.

2. The control method of the supercritical fluid drilling and blasting integrated double-arm drill jumbo according to claim 1, wherein a personnel seat, an operating platform, and the computer are arranged in the operation chamber.

3. The control method of the supercritical fluid drilling and blasting integrated double-arm drill jumbo according to claim 2, wherein the operation chamber and the supercritical fluid generation chamber are arranged above the bearing platform.

4. The control method of the supercritical fluid drilling and blasting integrated double-arm drill jumbo according to claim 3, wherein the supercritical fluid drilling and blasting integrated double-arm drill jumbo further comprises supporting legs and a crawler chassis, the crawler chassis is configured for driving and rotation of the supercritical fluid drilling and blasting integrated double-arm drill jumbo as a whole, the bearing platform is arranged on the crawler chassis, and the supporting legs are configured to maintain stability of the supercritical fluid drilling and blasting integrated double-arm drill jumbo during construction.

5. The control method of the supercritical fluid drilling and blasting integrated double-arm drill jumbo according to claim 4, wherein the storage tank stores the liquid water, liquid carbon dioxide, or liquid nitrogen.

6. The control method of the supercritical fluid drilling and blasting integrated double-arm drill jumbo according to claim 5, wherein the injection valve is arranged on the mixed-phase fluid injection port.

* * * * *